US008342642B2

(12) United States Patent
Bailey et al.

(10) Patent No.: US 8,342,642 B2
(45) Date of Patent: Jan. 1, 2013

(54) METHOD AND LATCHING ASSEMBLY FOR SECURING REPLACEABLE UNIT

(75) Inventors: Thomas Allen Bailey, Lexington, KY (US); Robert White Milgate, III, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 526 days.

(21) Appl. No.: 12/412,549

(22) Filed: Mar. 27, 2009

(65) Prior Publication Data

US 2010/0245469 A1 Sep. 30, 2010

(51) Int. Cl.
*B41J 23/00* (2006.01)
*B41J 2/175* (2006.01)

(52) U.S. Cl. ..... 347/37; 347/85; 347/86

(58) Field of Classification Search ..... 347/9, 37, 347/85–86, 20
See application file for complete search history.

(56) References Cited

U.S. PATENT DOCUMENTS

| | | | | |
|---|---|---|---|---|
| 6,623,105 | B1 * | 9/2003 | Shen | 347/49 |
| 2002/0167574 | A1 * | 11/2002 | Shinada et al. | 347/86 |
| 2004/0051764 | A1 * | 3/2004 | Cook et al. | 347/86 |
| 2008/0036813 | A1 * | 2/2008 | Conway et al. | 347/19 |

* cited by examiner

*Primary Examiner* — Jason Uhlenhake

(57) ABSTRACT

The invention describes a method and latching assembly for securing a replaceable unit in a carriage assembly of an image forming device. The latching assembly receives the replaceable unit in the carriage assembly. As the replaceable unit gets loaded in the carriage assembly, the latching assembly may automatically apply, using a power source in the image forming device, a force on the replaceable unit in a direction towards the carriage assembly until the replaceable unit is latched therein.

23 Claims, 6 Drawing Sheets

METHOD AND LATCHING ASSEMBLY FOR SECURING REPLACEABLE UNIT

BACKGROUND

1. Field of the Invention

The present invention relates generally to an image forming device, and more particularly, to a latching assembly for securing a replaceable unit in the image forming device.

2. Description of the Related Art

An image forming device, such as a printer, a scanner, and a copier processes an image and produces its copy as an output. The image forming device may produce the output by propelling droplets of liquid or molten material, such as ink, on print media, such as paper sheets, vinyl transparencies, cardstocks, labels, envelopes, and the like. Generally, the image forming device may include a cartridge or a tank which may contain ink that is spread on the print media during printing.

Typically, a user may install the cartridge by inserting it in the image forming device. To insert the cartridge and to create its sufficient electrical contact in the carriage assembly, the user may need to exert a force on the cartridge. However, users are known to exert differing amounts of forces when installing cartridges. This may result in a faulty or incorrect insertion of the cartridge in the image forming device. Additionally, an incorrectly placed cartridge may adversely affect the performance of the image forming device and in some instances cause device failure. Further, the user may also feel uncomfortable in applying the force on the cartridge to create the sufficient electrical contact. Similarly, in some cases, the user may not even be aware of the procedure of inserting the cartridge.

SUMMARY OF THE INVENTION

The embodiments of the present invention overcome the limitations of conventional image forming device; thereby satisfying the need for a method and a latching assembly for securing a replaceable unit in an image forming device. Various embodiments of the present invention are capable of automatically applying a consistent force on the replaceable unit. Further, the image forming device, according to the embodiments of the present invention, may automatically apply the force without adding any power generating components in the image forming device. Furthermore, the image forming device, according to embodiments of the present invention, requires minimal user intervention for latching the replaceable unit in its carriage assembly.

The embodiments of the present invention provide a method, latching assembly, and computer program product for securing a replaceable unit, such as a cartridge, in an image forming device. In an exemplary embodiment of the invention, the latching assembly in the image forming device may include a carriage assembly and a force applicator. A user may place the replaceable unit in the carriage assembly. In response to the placement of the replaceable unit, the image forming device may move the carriage assembly to a predetermined location. Once the carriage assembly is in the predetermined location, the image forming device may engage the carriage assembly with a power source through an operatively coupled force applicator. The force applicator may then generate a force by using the power source. Thereafter, the force applicator may apply the generated force on the replaceable unit in a direction towards the carriage assembly until the replaceable unit is latched therein.

The latching assembly, according to embodiments of the present invention, secures a replaceable unit in an image forming device by providing alternative ways/methods. The latching assembly also automatically applies a substantially consistent force on the cartridge until the replaceable unit is latched therein. Moreover, the latching assembly utilizes an existing power source in the image forming device for automatically generating and applying the consistent force, thereby removing the need for adding any other power generating components in the image forming device. Therefore, the latching assembly makes the cartridge insertion and removal a one-step process, and may ensure that the consistent force is delivered to the replaceable unit during the installation.

BRIEF DESCRIPTION OF THE DRAWINGS

The features mentioned above and others, and the advantages of this invention, and the manner of attaining them, will become more apparent and the invention will be better understood by reference to the following description of embodiments of the invention taken in conjunction with the accompanying drawings, wherein.

DETAILED DESCRIPTION OF DRAWINGS

Figure 1:
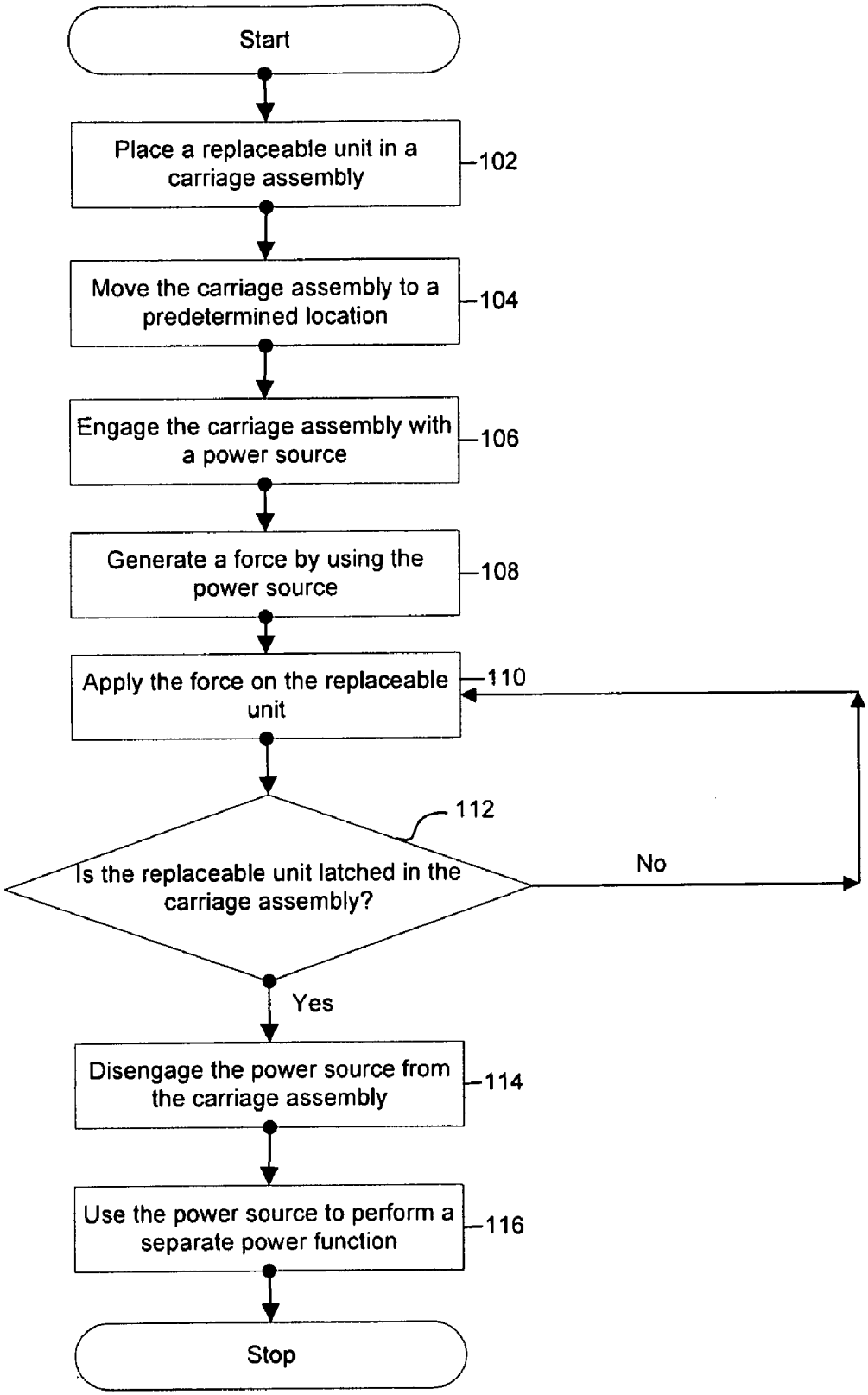
FIG. 1 depicts a flowchart illustrating an exemplary method for securing a replaceable unit in an image forming device, in accordance with an embodiment of the invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that the embodiments of the invention include both hardware and electronic components or modules that, for purposes of discussion, may be illustrated and described as if the majority of the components were implemented solely in hardware. However, one with ordinary skill in the art, and based on a reading of this detailed description, will recognize that, in at least one embodiment, the electronic-based aspects of the invention may be implemented in software. As such, it should be noted that a plurality of hardware- and software-based devices, as well as a plurality of different structural components, may be utilized to implement the invention. Furthermore, as described in the subsequent paragraphs, the specific mechanical configurations illustrated in the drawings are intended to exemplify the embodiments of the invention and that other alternative mechanical configurations are possible.

The embodiments of the present invention provide a latching assembly, method and computer program product for securing a replaceable unit in an image forming device. The method for securing the replaceable unit in the image forming device includes receiving the replaceable unit in a carriage assembly of the image forming device. In response to the placement of the replaceable unit in the carriage assembly, the image forming device automatically applies, using a power source in the image forming device, a force on the replaceable unit in a direction towards the carriage assembly, until the replaceable unit is latched therein.

The term, "image forming device" as used herein encompasses devices, such as color and black-and-white copiers, color and black-and-white printers, color and black-and-white scanners, and so-called "all-in-one devices" that incorporate multiple functions, such as scanning, copying, and printing capabilities in one device. Such image forming devices may utilize ink jet, dot matrix, dye sublimation, laser, and any other suitable printing formats. The term, "latching assembly" as used herein encompasses a combination of various components of the image forming device whose operations, movements, and the like are governed by a power received from the power source. The term, "force applicator" as used herein encompasses various components of the image forming device whose motion may be used for generating the force required for latching the replaceable unit in the carriage assembly.

FIG. 1 depicts a flowchart illustrating an exemplary method for securing a replaceable unit in an image forming device, in accordance with an embodiment of the invention.

At 102, a user may place the replaceable unit, such as a cartridge, an ink tank, or any device which is extractable from image forming device, in a carriage assembly of the image forming device for installation. In an embodiment of the invention, the carriage assembly in which the replaceable unit is not removable from the image forming device. However, it is understood that the carriage assembly may be removable and may be loaded into the image forming device after the replaceable unit has been secured in the carriage assembly. The user may thus load the replaceable unit in the carriage assembly externally and may then place the carriage assembly with the replaceable unit in the image forming device. The user may then directly place the replaceable unit in the carriage assembly of the image forming device. Thereafter, at 104, the image forming device may move the carriage assembly to a predetermined location. In an embodiment of the invention, the image forming device may sense the placement of the replaceable unit through one or more sensors and accordingly may operate a motor for moving the carriage assembly to the predetermined location. The motor may also be used to operate various other components of the image forming device. Various examples of the motor include, but are not limited to, an electric motor, a hydraulic motor, and a pneumatic motor.

Once the carriage assembly is in the predetermined location, then, at 106, the image forming device may engage the carriage assembly with a power source, such as a motor, in accordance with various embodiments of the invention. In an embodiment of the invention, the image forming device may directly engage the power source with the carriage assembly. In another embodiment of the invention, the image forming device may engage the carriage assembly with the power source through an operatively coupled force applicator. The force applicator may be a single component or a combination of various components of the image forming device, whose movement or operation is governed by the power received from the power source. For example, the force applicator may be a rotating object, a moving object (lateral), and so forth powered by the power source for its operation. Thereafter, at 108, the image forming device may generate a force by using the power source. This force causes latching of the replaceable unit in the carriage assembly. In an embodiment of the invention, the power source may itself generate the force required for latching the replaceable unit in the carriage assembly. In another embodiment of the invention, the power source may provide the power to the force applicator which may then generate the force required for latching the replaceable unit. Subsequently, at 110, the power source or the force applicator may apply the force on the replaceable unit in a direction towards the carriage assembly. At 112, the image forming device may then check whether or not the replaceable unit is latched in the carriage assembly. In an embodiment of the invention, the image forming device may sense the latching of the replaceable unit in the carriage assembly through one or more sensors which may provide feedback corresponding to the latching. If the replaceable unit is not latched in the carriage assembly, the image forming device may continue to apply the force on the replaceable unit. However, if the replaceable unit gets latched, then, in an embodiment of the invention as illustrated at 114, the image forming device may disengage the power source from the carriage assembly. Thereafter, at 116, the image forming device may use the power source to perform a separate power function, in accordance with various embodiments of the invention.

In accordance with various embodiments of the invention, the image forming device may employ any of a plurality of motors as the power source. The plurality of motors may be used to operate various components of the image forming device. For example, a motor used for operating a feed roller in the image forming device may be used as the power source for generating the force. Similarly, another motor configured for controlling the lateral movement of the carriage assembly in the image forming device, such as bringing the carriage assembly in front of the user when a door of the image forming device is opened and moving the carriage assembly for positioning the cartridge for printing, may be used as the power source for the force generation. In various embodiments of the invention, any motor configured to perform various power functions in the image forming device may be used as the power source to provide power to the force applicator. In some cases, an additional motor may be embedded in the image forming device which may be specifically used for providing the power either to the force applicator or directly to the replaceable unit. Further, an external motor may be used as the power source that may be configured to provide the power required for generating the force.

In an exemplary embodiment of the invention, a power source in the image forming device may also be used to automatically provide the force required for removing the replaceable unit from the image forming device. For example, one or more sensors may sense the opening of the door of the image forming device and accordingly the image forming device may initiate the operation of the motor to disengage the replaceable unit from the carriage assembly and automatically bring the carriage assembly in front of the user for extraction.

Figure 2A:
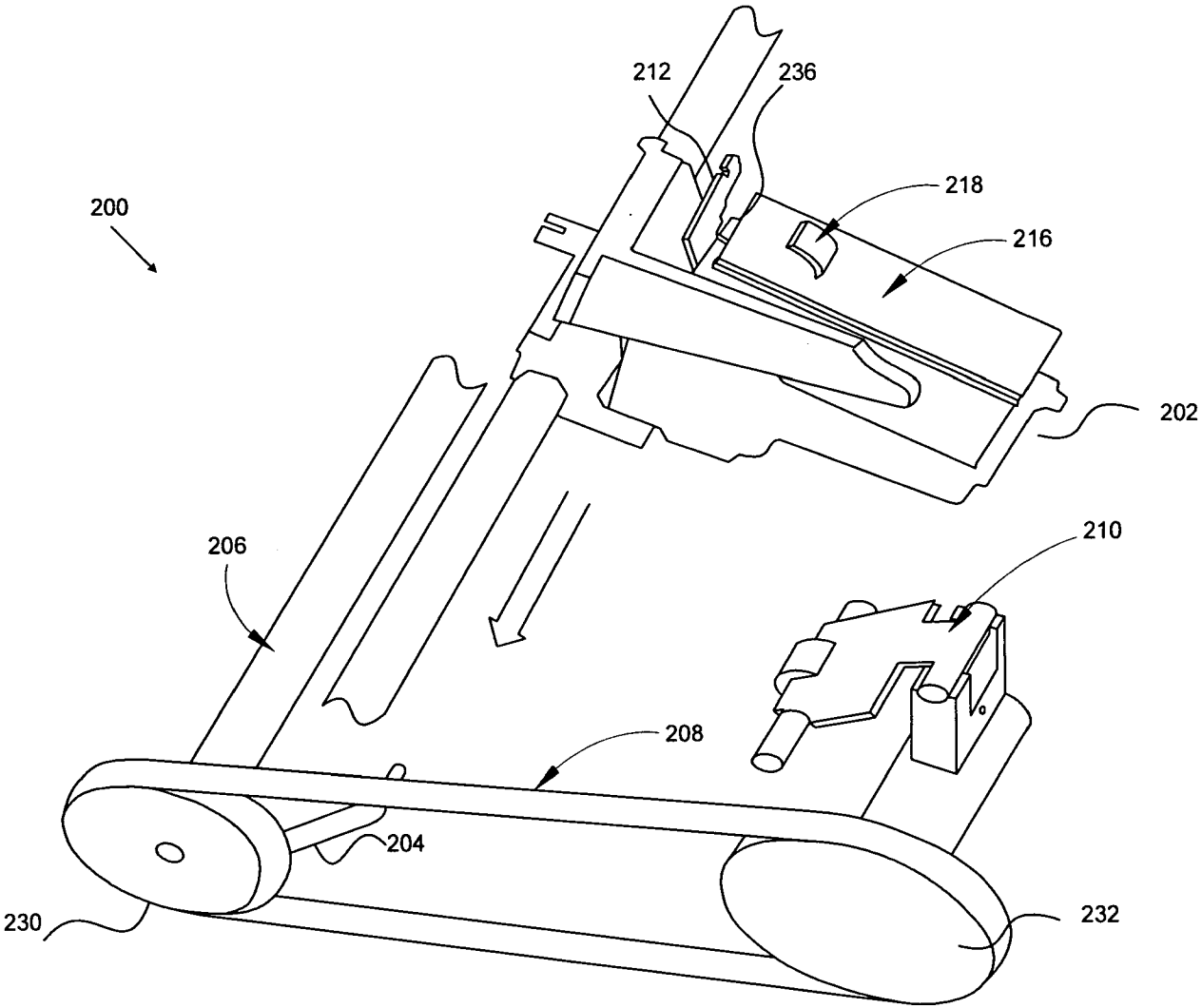
FIGS. 2A and 2B illustrate isometric views of an exemplary latching assembly from various alternative angles, in accordance with an exemplary embodiment of the invention.
Figure 2B:
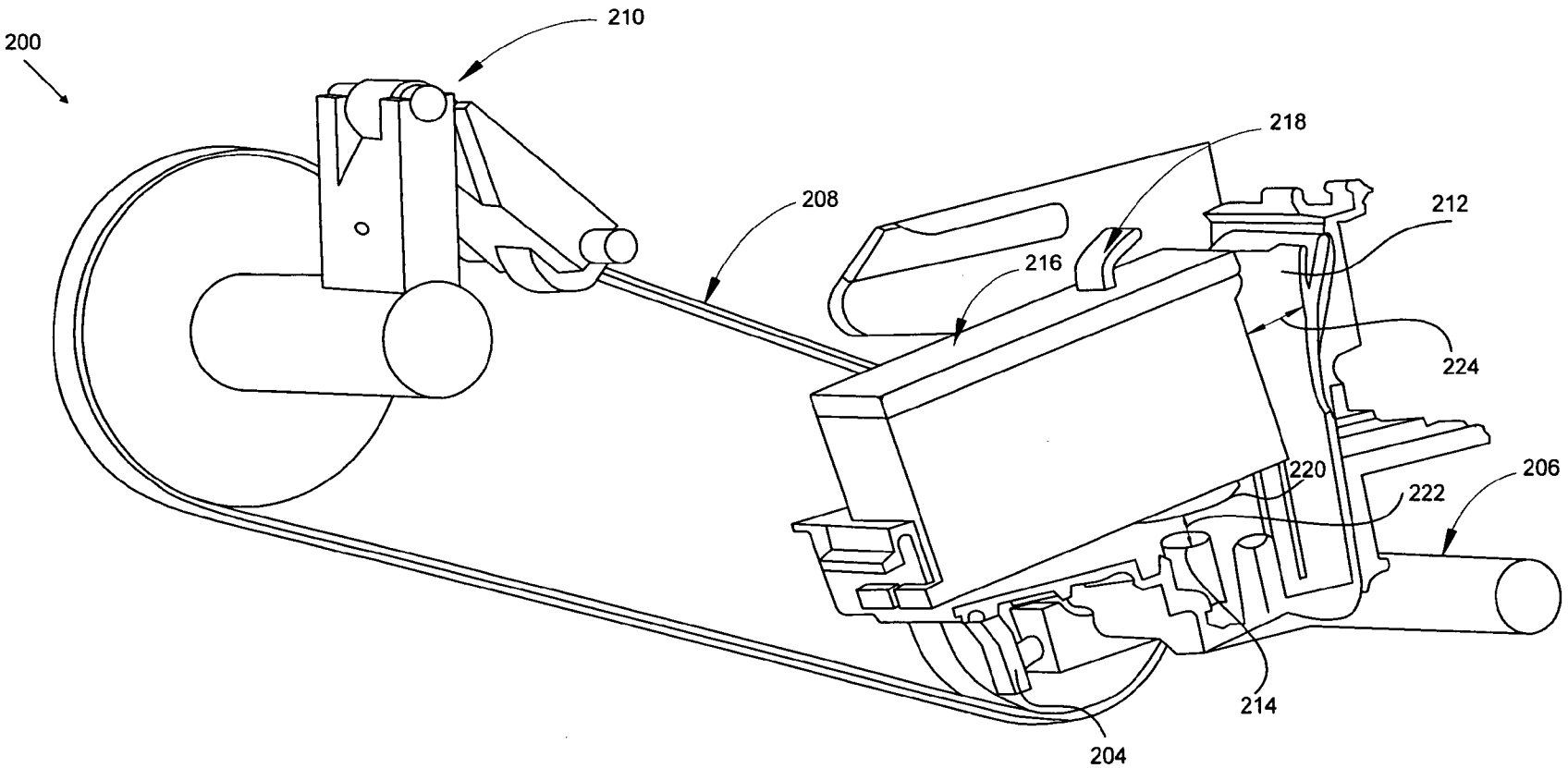

FIGS. 2A and 2B illustrate isometric views of an exemplary latching assembly 200 from various alternative angles, in accordance with an exemplary embodiment of the invention. Latching assembly 200 includes a carriage assembly 202, one or more engagement devices such as a clutch 204, a drive medium such as a feed roller 206, a transmission device such as a belt 208 or gear train, and a latching mechanism such as a mechanism including arm 210. Carriage assembly 202 includes a latching member such as a latching tab 212 and a base 214 which is sized to receive one or more replaceable units. Cartridge 216, the replaceable unit in this embodiment, includes a protruding member 218, a housing in which ink is stored, and a printhead 220. In an exemplary embodiment of the invention, as illustrated in FIGS. 2A and 2B, carriage assembly 202 may move laterally in the image forming device, in a direction that is substantially parallel to feed roller 206, as shown by the arrow in FIG. 2A.

A user may load cartridge 216 in carriage assembly 202 for installation. Carriage assembly 202 provides a structural support for cartridge 216. In an embodiment of the invention, carriage assembly 202 is not removable from the image forming device. The user may thus directly place cartridge 216 in carriage assembly 202 of the image forming device. Carriage assembly 202 may include latching tab 212, which is configured to latch cartridge 216. However, as depicted in FIG. 2B, there are gaps illustrated as a first gap 222 between the bottom of cartridge 216 and base 214 of carriage assembly 202, and a second gap 224 between a side of cartridge 216 and latching tab 212. In this state, cartridge 216 is unlatched in carriage assembly 202. In an embodiment of the invention, one or more sensors may be embedded in carriage assembly 202 and accordingly may provide feedback corresponding to a placement of cartridge 216 in carriage assembly 202. In response to the feedback received from the one or more sensors, the image forming device may move carriage assembly 202 in the proximity of clutch 204.

Clutch 204 operatively couples feed roller 206 and hub 230 together when actuated. Clutch 204 is actuated when carriage assembly 202 contacts or otherwise engages clutch 204. With clutch 204 activated, rotation of feed roller 206 imparts rotation of hub 230, which thereupon imparts rotation of hub 232 via belt 208. Rotation of hub 232 induces movement of arm 210 to latch cartridge 216 within carrier assembly 202.

In an embodiment of the invention, various transmission devices, for example, a belt, a chain or a sprocket, or gear train may be used to operatively couple feed roller 206 with arm 210. Feed roller 206 may also be operatively connected with a motor (not shown), as described in conjunction with FIG. 1. The motor may provide the power required for operating feed roller 206. Feed roller 206 may generate a mechanical force by using the motor, and accordingly may transmit the mechanical force to arm 210 through hubs 230, 232 and belt 208.

It is understood that mechanisms other than feed roller 206 and its motor may be used to activate the latching mechanism. A benefit in using feed roller 206 is that feed roller 206 is not utilized for moving media sheets when a cartridge is being installed in the image forming device. As a result, utilizing feed roller 206 and its motor to securely install cartridge 216 does not otherwise affect the operation of the image forming device.

Figure 3A:
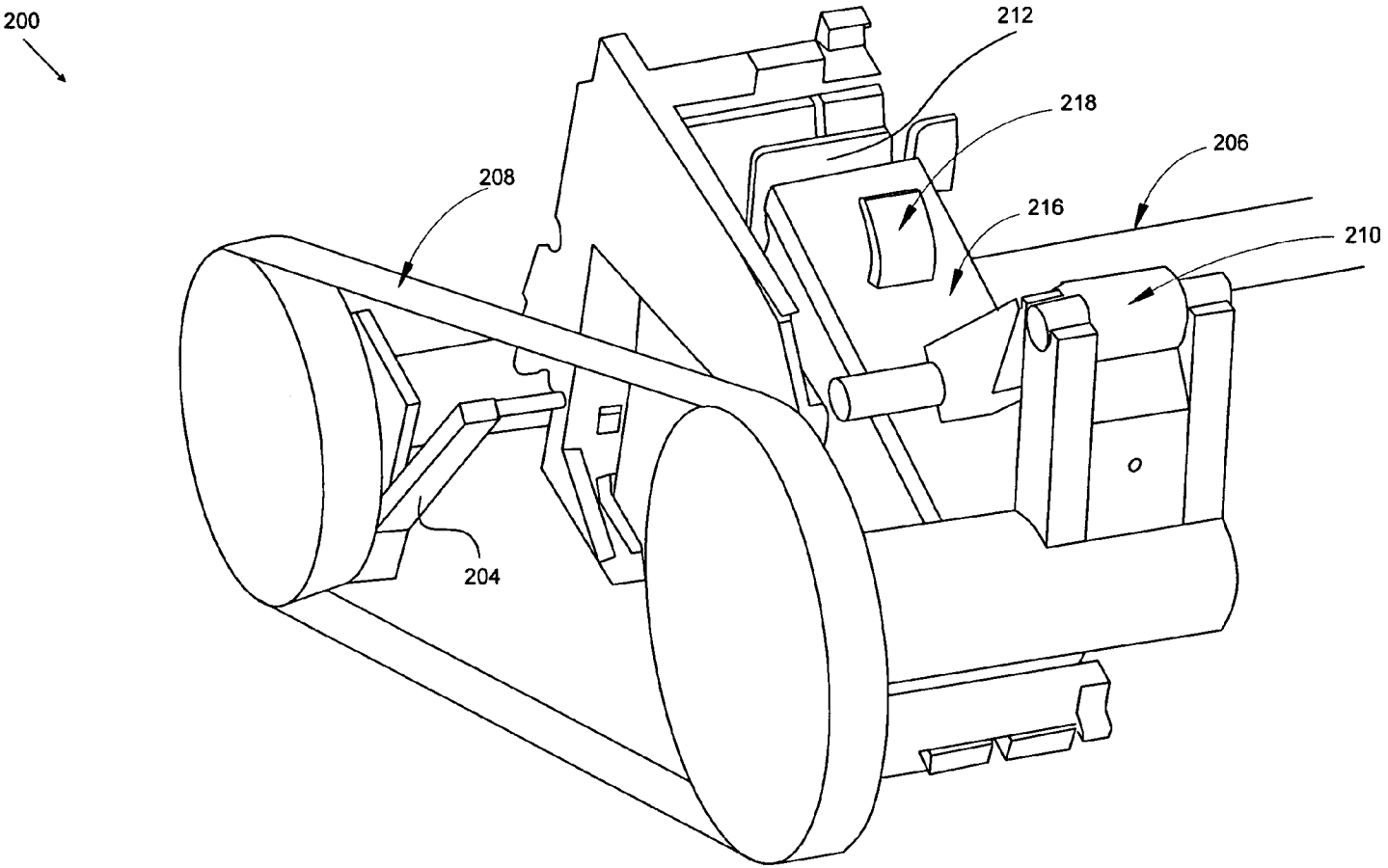
FIGS. 3A, 3B and 3C illustrate perspective views of various stages during the operation of an exemplary latching assembly, in accordance with the exemplary embodiment of the invention.
Figure 3B:
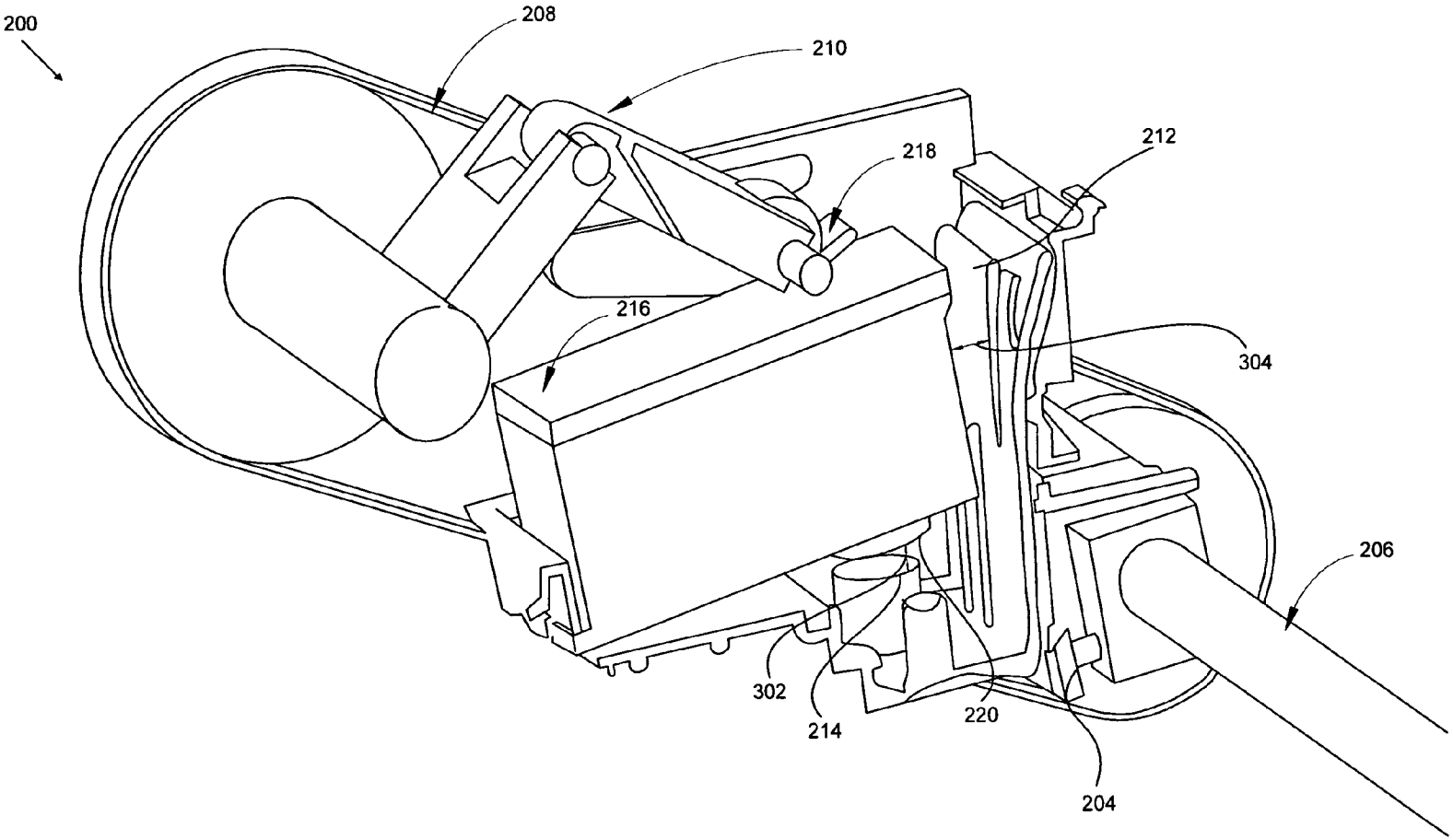
Figure 3C:
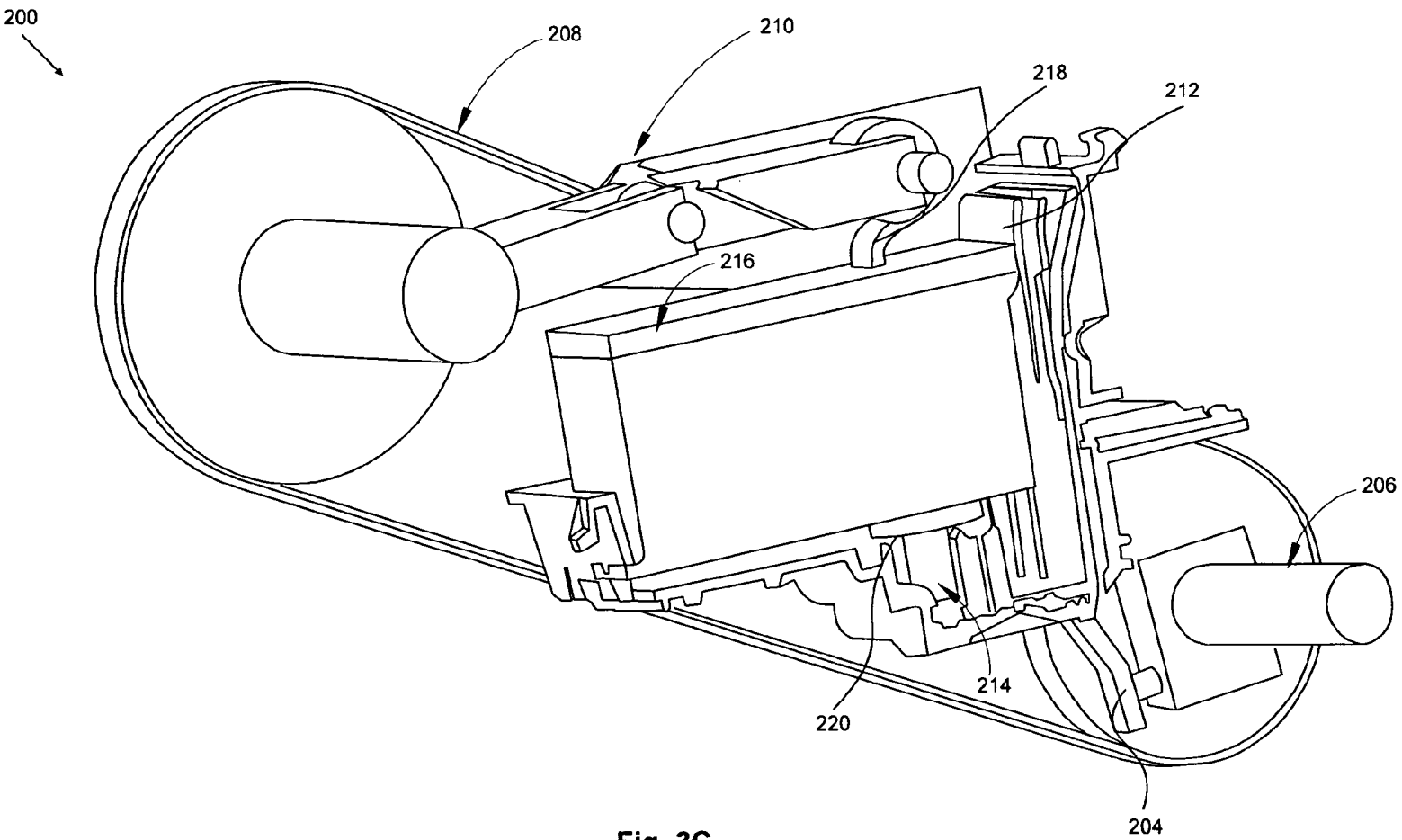

FIGS. 3A, 3B and 3C illustrate perspective views of various stages during the operation of latching assembly 200, in accordance with an exemplary embodiment of the invention.

As depicted in FIG. 3A, carriage assembly 202 moves towards a predetermined location in response to the placement of cartridge 216 in carriage assembly 202. Once carriage assembly 202 is placed in the predetermined location, carriage assembly 202 contacts or otherwise connects with clutch 204. As a result, clutch 204 is activated and may engage hub 230 with feed roller 206.

Once clutch 204 is activated and engages hub 230 with feed roller 206, the motor may start its operation, and thus, rotate feed roller 206. In an embodiment of the invention, one or more sensors may be used for sensing the connection of carriage assembly 202 with clutch 204 and accordingly the image forming device may then initiate the operation of the motor. As mentioned above, rotation of feed roller 206 imparts rotation of hub 230 which thereupon imparts rotation of hub 232 which causes movement of arm 210 of the latching mechanism from its initial, extracted position shown in FIG. 3A. Continued movement of arm 210, which in this case includes rotational movement of a base portion of arm 210, causes an outer end of arm 210 to partially extend outwardly from its base portion until the outer end of arm 210 contacts protruding member 218 of cartridge 216, as shown in FIG. 3B. Still further rotational movement of the base portion of arm 210 causes arm 210 to extend further outwardly, thereby generating a force on protruding member 218 of cartridge 216 so as to urge cartridge 216 inwardly towards carriage assembly 202. This urging causes gaps 302 and 304 to lessen between cartridge 216 and carrier assembly 202 (FIG. 3B). Cartridge 216 is capable of being urged into carriage assembly 202 in part by latch tab 212 temporarily flexing away from cartridge 216 responsive to the urging.

When arm 210 is substantially fully extended due to continued rotation of the base portion of arm 210, as shown in FIG. 3C, cartridge 216 is fully inserted within carriage assembly 202. At this point, gaps 302 and 304 are substantially minimized and latch tab 212 engages with the top and/or side portion of cartridge 216. In particular, latch tab 212 may include an aperture which engages with and receives tab member 236 of cartridge 216 (FIG. 2A). Alternatively, latch tab 212 may include a ledge (not shown) which engages with a top edge of cartridge 216. It is understood that any of a number of mechanisms may be used to latch cartridge 216 with carriage assembly 202.

As described above, movement of arm 210 may generate a mechanical force required for latching cartridge 216 in carriage assembly 202. In an embodiment of the invention, arm 210 may translate an axial mechanical force along a linkage and may extend its mechanical arm for applying the mechanical force on cartridge 216.

In an embodiment of the invention, one or more sensors may be used for providing feedback corresponding to the engagement of cartridge 216 with latching tab 212. In response to confirmatory feedback, which may confirm the engagement of cartridge 216 with latching tab 212, the image forming device may reverse the rotation of feed roller 206, and thus reverse the rotation of hubs 230 and 232 and cause the retraction of arm 210 to its initial position. Carriage assembly 202 then may be moved away from clutch 204 so as to disconnect therefrom, which deactivates clutch 204. Deactivation of clutch 204 disengages hub 230 from feed roller 206, thereby making feed roller 206 and its corresponding motor available for performing other printing related functions.

In an exemplary embodiment of the invention, instead of using feed roller 206, the image forming device may employ a shaft, a rotor or a crank to apply the generated force on the replaceable unit.

The latching assembly and method described above improve the securing of a replaceable unit in an image forming device by providing alternative ways or methods. The latching assembly may also automatically apply a consistent force on the replaceable unit in a direction towards a carriage assembly until the replaceable unit is latched therein. Thus, the user need not apply force on the replaceable unit. Further, the method may utilize an existing power source in the image forming device for automatically generating and applying the consistent force; thereby removing the need for adding any other components in the image forming device. Furthermore, the method and latching assembly may make the replaceable unit insertion and removal a one-step process, and may require minimal user intervention for latching the replaceable unit in the carriage assembly.

It is understood that the image forming device utilizing the latching assembly according to embodiments of the present invention may include other components, assemblies and modules commonly found in image forming devices.

One or more components used for operating and sensing in the image forming device to secure a replaceable unit in the image forming device, as described above with respect to various embodiments of the present invention, may initiate a controller for executing a computer readable program code for a computer system. Typical examples of a computer system include a general-purpose computer, a programmed microprocessor, a microcontroller, a peripheral integrated circuit element, and other devices or arrangements of devices that are capable of implementing the functions and operations described above.

Such a computer system comprises a computer, an input device, and a display unit. The computer may include a microprocessor and memory, both volatile and non-volatile. The computer system may also include a storage device such as a disk drive (hard disk drive, optical disk drive or solid state drive). The storage device can also be other similar means for loading computer programs or other instructions into the computer system. The computer system may also include a communication unit for accessing other databases and the Internet through an I/O interface. The communication unit may allow the transmission as well as reception of data from other databases. The communication unit may include a modem, an Ethernet card, or any other device which enables the computer system to connect to databases and networks such as LAN, MAN, WAN, and the Internet. The computer system may facilitate inputs from a user through input device, accessible to the system through the I/O interface.

The computer system executes a set of instructions that are stored in one or more computer usable mediums, in order to process input data. The storage elements may also hold data or other information as desired. The storage element may be in the form of an information source or a physical memory element present in the processing machine.

The set of instructions may include various commands that instruct the computer system to perform the specific tasks and operations described above. The set of instructions may be in the form of a software program. Further, the software may be in the form of a collection of separate programs, a program module with a larger program or a portion of a program module. The software may also include modular programming in the form of object-oriented programming. The processing of input data by the processing machine may be in response to user commands, results of previous processing or a request made by another processing machine.

The foregoing description of several methods and embodiments of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for securing a replaceable unit in an image forming device, the method comprising:

receiving the replaceable unit in a carriage assembly of the image forming device;

automatically applying, using a power source in the image forming device, a force on the replaceable unit in a direction towards the carriage assembly, until the replaceable unit is latched therein; and using the power source to perform a separate power function when the force is not being applied.

2. The method of claim 1 further comprising moving the carriage assembly to a predetermined location prior to applying the force.

3. The method of claim 2 further comprising engaging the power source to apply the force when the carriage assembly is in the predetermined location.

4. The method of claim 1, wherein the separate power function comprises operating a feed roller in the image forming device.

5. The method of claim 1 further comprising, prior to applying the force, moving one of the carriage assembly and a force applicator relative to the other, the force applicator applying the force on the replaceable unit, the force applicator being powered by the power source.

6. The method of claim 1 further comprising disengaging the power source once the replaceable unit is latched.

7. A latching assembly for securing a replaceable unit within an image forming device comprising:

a carriage assembly for receiving the replaceable unit in the image forming device, the carriage assembly including a latching member;

a force applicator for applying a mechanical force on the replaceable unit until the replaceable unit engages with the latching member and is thereby secured within the carriage assembly; and a motor in the image forming device coupled to the force applicator for moving the force applicator in a direction towards the carriage assembly, wherein the force applicator further comprises a drive medium being powered by the motor, the drive medium being configured for generating the mechanical force, wherein the drive medium is selected from at least one of a shaft, a rotor, a feed roller and a crank.

8. The latching assembly of claim 7 further comprising one or more engagement devices for engaging the carriage assembly with the force applicator.

9. The latching assembly of claim 7 further comprising one or more sensors for providing feedback corresponding to the engagement of the replaceable unit with the latching member.

10. The latching assembly of claim 7, wherein the force applicator further comprises a latching mechanism, the latching mechanism being configured for providing the mechanical force on the replaceable unit in a direction towards the carriage assembly until the replaceable unit is latched therein.

11. The latching assembly of claim 10, wherein the latching mechanism comprises one or more of cams for providing the mechanical force on the replaceable unit.

12. The latching assembly of claim 10, wherein the force applicator further comprises a transmission device coupled to the drive medium and the latching mechanism for transmitting the mechanical force generated by an operation of the drive medium to the latching mechanism, wherein the transmission device is selected from at least one of a gear train, a belt, a chain and a sprocket.

13. The latching assembly of claim 7, wherein the replaceable unit is one of a cartridge and an ink tank.

14. The latching assembly of claim 7, wherein the carriage assembly is replaceable relative to the image forming device.

15. The latching assembly of claim 7, wherein the carriage assembly is fixed relative to the image forming device.

16. The latching assembly of claim 7, wherein the force applicator comprises an arm having a base portion that is rotatable about a first end thereof, and an extension portion pivotably coupled to the base portion for engaging with the replaceable unit upon rotation of the base portion.

17. The latching assembly of claim 16, wherein an angle formed between the base portion of the arm and the extension portion thereof increases as the base portion is rotated during a latching operation.

18. The latching assembly of claim 16, wherein an angle formed between the base portion of the arm and the extension portion thereof changes as the base portion is rotated during a latching operation.

19. A computer program product for use with a controller for securing a replaceable unit in an image forming device, the computer program product comprising a non-transitory computer usable medium having a computer readable program code embodied therein which, when executed by the controller, causes the image forming device to perform:

activating a motor to control movement of a carriage assembly;

sensing a placement of the replaceable unit in the carriage assembly;

moving the carriage assembly to a predetermined location in response to the placement of the replaceable unit;

activating a power source in the image forming device to move a force applicator;

automatically engaging the force applicator, using the power source in the image forming device with the replaceable unit to apply a force on the replaceable unit in a direction towards the carriage assembly, until the replaceable unit is latched therein, and using the power source to perform a separate power function when the force is not being applied.

20. The computer program product of claim 19, further comprising the computer readable program code for sensing a latching of the replaceable unit in the image forming device.

21. A latching assembly for securing a replaceable unit within an image forming device comprising:

a carriage assembly for receiving the replaceable unit in the image forming device, the carriage assembly including a latching member;

a force applicator for applying a mechanical force on the replaceable unit until the replaceable unit engages with the latching member and is thereby secured within the carriage assembly; and a motor in the image forming device coupled to the force applicator for moving the force applicator in a direction towards the carriage assembly, wherein the force applicator comprises an arm having a base portion that is rotatable about a first end thereof, and an extension portion pivotably coupled to the base portion for engaging with the replaceable unit upon rotation of the base portion.

22. The latching assembly of claim 21, wherein an angle formed between the base portion of the arm and the extension portion thereof increases as the base portion is rotated during a latching operation.

23. The latching assembly of claim 21, wherein an angle formed between the base portion of the arm and the extension portion thereof changes as the base portion is rotated during a latching operation.

* * * * *